United States Patent [19]

Leicht et al.

[11] Patent Number: 4,702,672

[45] Date of Patent: Oct. 27, 1987

[54] FLUID FLOW MACHINE

[75] Inventors: Werner Leicht, Stetten; Georg Ruetz, Immenstaad; Juergen Giesselmann, Markdorf, all of Fed. Rep. of Germany

[73] Assignee: MTU Friedrichschafen GmbH, Friedrichschafen, Fed. Rep. of Germany

[21] Appl. No.: 837,696

[22] Filed: Mar. 10, 1986

[30] Foreign Application Priority Data

May 9, 1985 [DE] Fed. Rep. of Germany ..... 3516738

[51] Int. Cl.[4] ..... F01D 17/16

[52] U.S. Cl. ..... 415/164; 415/171

[58] Field of Search ..... 415/160–164, 415/150, 151, 156, 171

[56] References Cited

U.S. PATENT DOCUMENTS

| | | | |
|---|---|---|---|
| 2,904,307 | 9/1959 | Balje | 415/164 X |
| 3,033,519 | 5/1962 | Radtke | 415/163 X |
| 3,101,926 | 8/1963 | Weber | 415/164 X |
| 3,408,049 | 10/1968 | Willi | 415/150 |
| 3,791,761 | 2/1974 | Hayes | 415/163 |
| 3,945,762 | 3/1976 | Leicht | 417/18 |
| 4,300,869 | 11/1981 | Swearingen | 415/164 X |
| 4,355,953 | 10/1982 | Nelson | 415/164 |
| 4,403,913 | 9/1983 | Fisker | 415/150 |

FOREIGN PATENT DOCUMENTS

| | | | |
|---|---|---|---|
| 1071420 | 12/1959 | Fed. Rep. of Germany . | |
| 3325756 | 9/1984 | Fed. Rep. of Germany . | |
| 674460 | 1/1930 | France . | |
| 1442174 | 5/1966 | France . | |
| 2064617 | 6/1971 | France . | |
| 491338 | 3/1954 | Italy | 415/160 |
| 731822 | 6/1955 | United Kingdom . | |
| 861630 | 2/1961 | United Kingdom . | |
| 880903 | 10/1961 | United Kingdom . | |
| 2071218 | 9/1981 | United Kingdom . | |

*Primary Examiner*—Robert E. Garrett
*Assistant Examiner*—Joseph M. Pitko
*Attorney, Agent, or Firm*—Barnes & Thornburg

[57] ABSTRACT

A fluid flow machine of the radial type of construction with adjustable guide blades in a radially extending annular channel of the fluid flow housing. The bearing support of the guide blades takes place in a guide blade carrier that represents a one-piece bearing cage with lateral flow surfaces for the guide blades. The guide blade carrier is composed of two bearing rings which are combined into one structural unit by way of fixed connecting webs disposed in the flow path. In this structural unit, the space for the guide blades can be machined very accurately in its axial width to maintain the tolerances which means small gap losses and correspondingly favorable efficiencies. Since the guide blade carrier is so arranged in the housing that expansions of the housing by reason of heat or pressure warping are not transmitted, the gap tolerances can be selected correspondingly still smaller, and the efficiency can be still further improved. It is also significant that the fluid flow machine and its components can be constructed particularly simple from a constructive point of view and particularly reliable in operation by means of the housing-independent bearing support of the guide blades in the guide blade carrier.

12 Claims, 5 Drawing Figures

FLUID FLOW MACHINE

The present invention relates to a fluid flow machine with a radial rotor arranged in the fluid flow housing as well as with adjustable guide blades arranged in a radially extending annular channel of the fluid flow housing which are rotatably supported by means of bearing pins in bearing bores of the housing parts forming the annular channel as disclosed, for example, in the U.S. Pat. No. 3,945,762.

An exhaust gas turbocharger with a radial compressor and a radial turbine is disclosed in the aforementioned publication. Adjustable guide blades are arranged in an annular channel of the turbine housing, through which the fluid medium flows in the radial direction. The guide blades are provided at their narrow sides with bearing pins which are rotatably supported in bearing bores provided in the annular channel wall adjoining the bearing housing. Actuating levers engage at the bearing pins which cooperate with an adjusting ring. Gaps result between the annular channel walls and the narrow sides of the guide blades which influence the efficiency of the fluid flow machine. The gap width is particularly unfavorable in the disclosed construction in which the tolerance of housing parts attached at one another determine the annular channel width. For the dimensioned accuracy of a structural component composed of different parts as represents, for example, the compressor housing and the turbine housing—whereby the latter may not be constructed in one piece, contrary to the drawing, if the rotor and guide blades are to be attached—is dependent on the predetermined constructive tolerances which can still be realized with economically acceptable expenditures. A subsequent machining or finishing of the determinative housing walls is no longer possible in the assembled condition. The distance between the annular channel walls may correspondingly vary between a minimum and maximum value. The blade widths must therefore be selected smaller than the minimum width of the annular channel. Also, the influence of the warping of the housing parts by reason of the threaded connection and of the pressure and heat stresses of the housing must be taken into consideration in the selection of the blade width. This leads, as already mentioned, to undesirably large gaps and corresponding influencing of the efficiency.

The present invention is concerned with the task to constitute the fluid flow machine constructively as simple as possible and operationally as reliable as possible as regards the bearing support of the guide blades and to thereby improve the efficiency by a reduction of the gap losses.

The underlying problems are solved according to the present invention in that mutually opposite bearing rings are embedded in the housing parts forming the annular channel, which are rigidly coupled at one another by means of connecting webs into a one-piece structural part—the guide blade carrier—, which bearing rings contain the bearing bores for a bearing support of the guide blades on both sides, and whose surfaces form lateral flow surfaces within the area of the guide blades.

The guide blade carrier, consisting of two bearing rings which are rigidly and nondetachably connected with each other by connecting webs, forms a separate component or structural part which represents a one-piece bearing cage with lateral flow surfaces for the guide blades. On this constructively simple structural part, the space for the guide blades can be machined very accurately in its axial width to maintain the dimensional accuracy which means small gap widths and correspondingly improved efficiency. In one embodiment of the present invention, the guide blade carrier is supported in the housing on one side in such a manner that warpings of the bearing- and fluid-flow-housings as a result of heat and pressure loads are not transmitted to the guide blade carrier and such influences therefore need not be taken into consideration in the determination of the gap widths.

Furthermore, it is advantageous that the fluid housing having a fluid medium inlet and outlet can be rotated with respect to the bearing housing into any desired positions without changing the guide blade positions because they are supported in the guide blade carrier completely independently.

These and other objects, features and advantages of the present invention will become more apparent from the following description when taken in connection with the accompanying drawing which shows, for purposes of illustration only, one embodiment in accordance with the present invention, and wherein.

Figure 1:
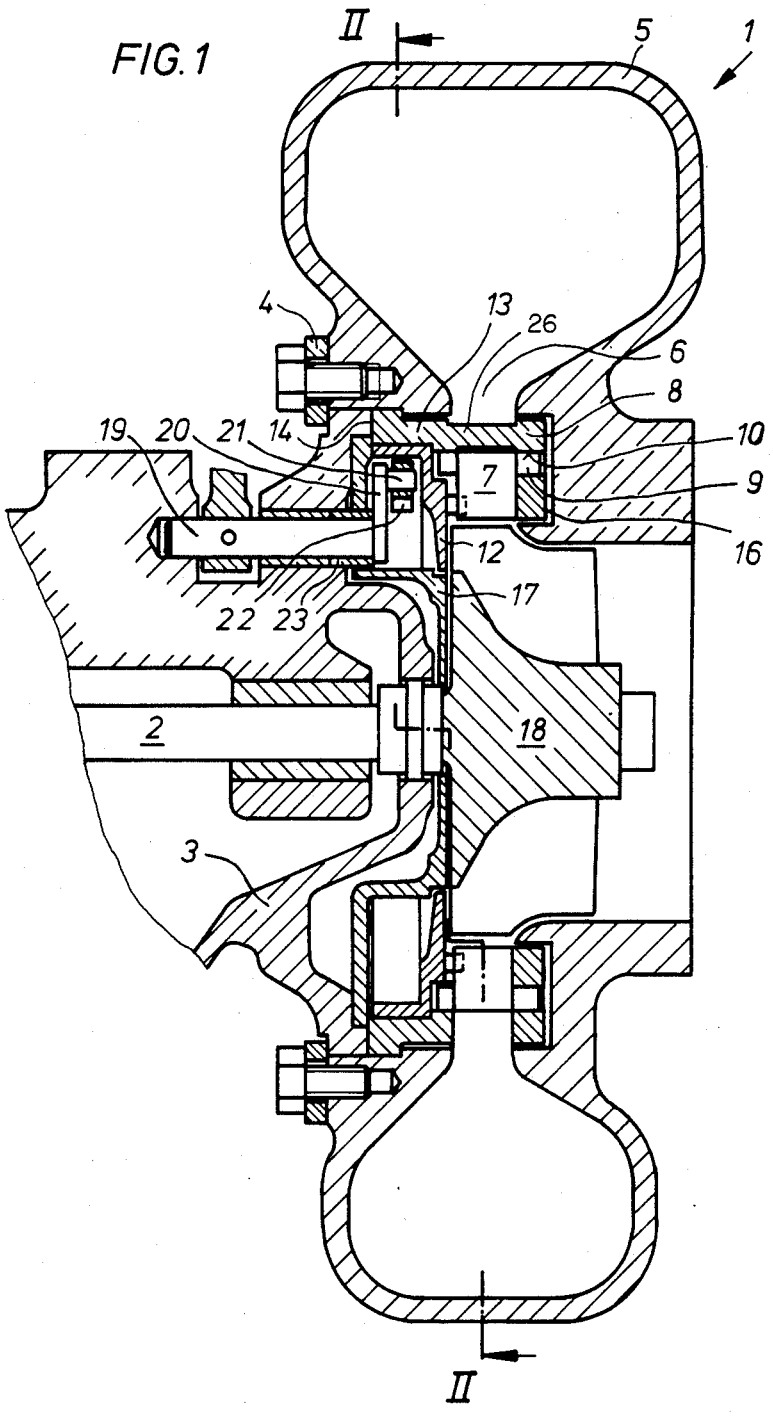
FIG. 1 is a longitudinal cross-sectional view through the turbine of an exhaust gas turbocharger with guide blades adjustable in a guide blade carrier according to the present invention.

Referring now to the drawing wherein like reference numerals are used throughout the various views to designate like parts, and more particularly to FIG. 1, this figure is a longitudinal cross-sectional view through the turbine generally designated by reference numeral 1 of an exhaust gas turbocharger. The associated compressor connected with the turbine 1 by way of a common shaft 2 is not illustrated. The fluid flow housing 5 is axially clamped against the bearing housing 3 by way of a clamping ring 4 threadably secured at the fluid flow housing 5. The shaft 2 is supported in the bearing housing 3. Adjustable guide blades 7 are arranged in an annular channel which extends radially and which is traversed by the fluid medium from the outside toward the inside. The guide blades 7 are rotatably supported in a guide blade carrier 8 on bearing pins 9 which engage in bearing bores 10 of an outer lateral bearing ring—on the fluid medium outled side—and of an inner lateral bearing ring—on the bearing housing side—of the guide blade carrier 8. The bearing rings are joined to the guide blade carrier 8 by way of some connecting webs 26 which are located within the flow path. The connecting webs 26 rigidly connect with each other the bearing rings. They are, for example, welded together with the bearing rings or nondetachably connected with the bearing rings in any other suitable manner.

Within the area of the guide blades 7, the inner surfaces of the bearing rings form at least partially the boundary or flow surfaces for the fluid medium flowing through the annular channel 6. On the bearing housing side, the flow surface is also partially formed within the area of the guide blades by the adjusting ring 12 provided with cams 11 (FIG. 2) preferably projecting into the fluid-flow channel. In order that no flow-impeding component edges occur, the adjusting ring 12 represents the lateral flow surface also within the area of the guide blades. Furthermore, an annular flange 13, which is formed-on at the guide blade carrier 8, is supported with its end face 14 at the bearing housing 3 and at the same time is clamped fast at an outer shoulder against the fluid flow housing 5 supported at the bearing housing 3. Axially fixed in this manner, an axial expansion gap 16 may be provided between the outer bearing ring and the housing aperture into which it is embedded, which permits an axial expansion of the guide blade carrier 8. However, any warping occurring as a result of heat or pressure expansions of the housing part is not transmitted with this unilateral clamping arrangement of the guide blade carrier 8 at the annular flange 13. Furthermore, a section of a heat shield 17 is clamped-in between the end face 14 of the ring flange 13, formed-on at the guide blade carrier 8, and the bearing housing 3, which intercepts excessive heat flow to the bearing housing 3 and represents the flow wall within the area of the rotor 18. An axially extending section of the adjusting ring 12 is axially, but rotatably fixed between an inner shoulder of the annular flange 13 and the heat shield 17 supported at the bearing housing 3. For the adjustment of the adjusting ring 12, an adjusting shaft 19 is arranged in the bearing housing 3 whose rotations are transmitted onto an actuating lever 20 which engages with an axial pin 21 in a lug 22 which is connected with the adjusting ring 12. In the passage of the adjusting shaft 19 through the heat shield 17, the adjusting shaft 19 is preferably supported in a heat-insulating ceramic bushing 23. In order to attain a gas-tightness, the adjusting shaft 19 may be axially stressed against the ceramic bushing 23 by means of a spring (not shown).

Figure 2:
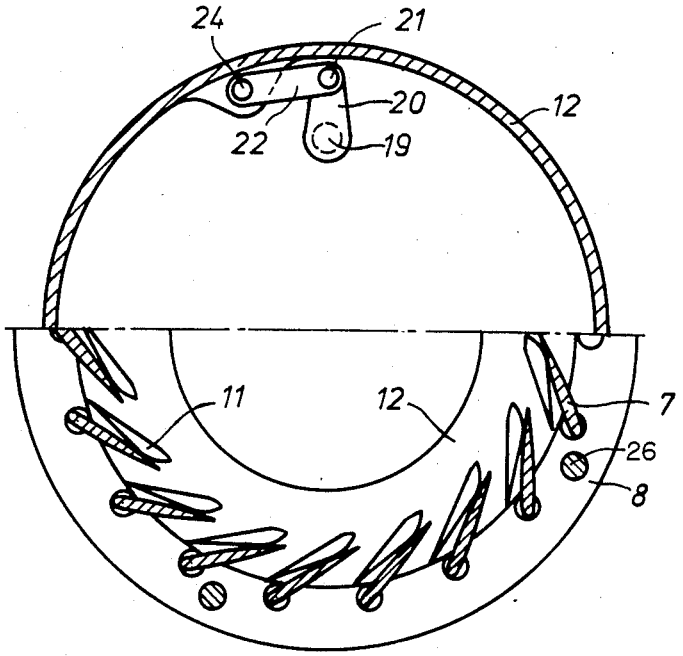
FIG. 2 is a cross-sectional view through the turbine taken along line II—II of FIG. 1.

FIG. 2 illustrates a cross-sectional view of the turbine 1 along the cross-sectional line II—II indicated in FIG. 1. In the upper half of the cross-sectional view, the pin 21 of the adjusting shaft 19 is shown which engages in the lug 22 that is operatively connected by way of a pin 24 with the radially drawn-in edge of the adjusting ring 12. The pin 24 engages in an elongated aperture (not shown) of the heat shield 17 which extends in the circumferential direction, as a result of which the adjusting path is limited. Another non-illustrated possibility to limit the adjusting path 5 should be mentioned at this place. A radially outwardly directed limit pin connected with the adjusting ring engages in a limited aperture of the annular flange of the guide blade carrier. The improved heat shielding with respect to the hot gas space is of advantage in this case, for an aperture for the passage of the limit pin can be dispensed with.

In the lower half of the cross-sectional view of FIG. 2, the adjusting ring 12 with its cam-shaped raised portions is illustrated which cooperate within the area of the guide blade ends with the guide blades 7 for their positional change for different operating conditions of the exhaust gas turbocharger. The cam-shape is constructed streamlined, preferably in the form of blade profiles.

Figure 4:
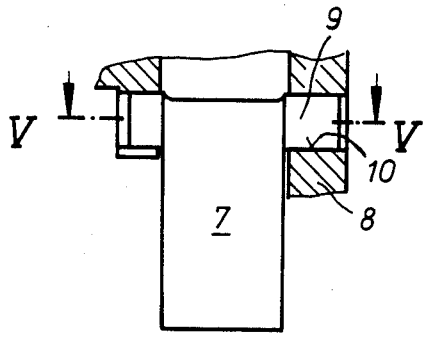
FIG. 4 is a partial cross-sectional view taken along line IV—IV of FIG. 3.
Figure 3:
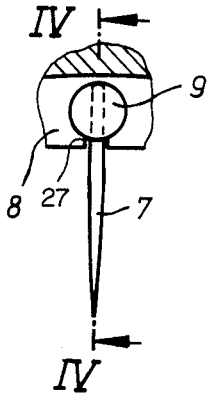
FIG. 3 is a partial cross-sectional view within the area of the bearing support through the bearing ring of the guide blade carrier on the side of the bearing housing.
Figure 5:
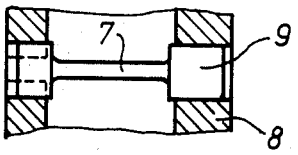
FIG. 5 is a partial cross-sectional view taken along line V—V of FIG. 4.

FIGS. 3 to 5 illustrate the bearing support of a guide blade 7 in different views.

FIG. 3 illustrates a cross section within the area of the bearing support through the bearing ring of the guide blade carrier 8 on the side of the bearing housing transversely to the bearing pin 9. It can be seen from this figure that the bearing bore 10 possesses within the area of the bearing pin connection a radial access 27 of the width of the blade profile. It can also be recognized that the diameter of the bearing pin 9 is considerably larger than the blade width so that notwithstanding the radial aperture of the bearing bore, a safe canting-free guidance of the bearing pin 9 is assured. The bearing pins 9 may have different diameters or may also be of different length. As a result thereof, an incorrect installation position is precluded during the insertion into the guide blade carrier 8.

FIG. 4 illustrates the view of the bearing support along line IV—IV of FIG. 3.

FIG. 5 shows the view of the bearing support along the cross-sectional line V—V of FIG. 4. It can be seen from FIGS. 4 and 5 that the bearing bore 10 is axially accessible only in the outer bearing ring. The insertion of the guide blades 7 which are provided with rigidly connected bearing pins 9, takes place in a radial movement and in a subsequent axial movement in which the bearing pins 9 are inserted into the bearing bores 10. Upon completion of the radial movement, a profile section of the blades is disposed in the slot of the one bearing bore. However, it is also possible to construct both bearing bores nonslotted. However, the bearing pins in that case cannot be constructed in one piece with the guide blades, but must be constructed attachable at the guide blades.

A structural unit as is represented by the guide blade carrier can be machined in its axial width to very accurate dimensions of the space for the guide blades prior to the insertion of the guide blades. This means that the gap losses are kept correspondingly small and therewith efficiencies are attainable which are more favorable than with corresponding bearing support of the guide blades between the housing walls or bearing rings connected with the housing walls but not rigidly coupled at one another. Since further the guide blade carrier can be so arranged in the housing that any warping of the housing as a result of pressure and thermal stresses are not transmitted to the guide blade carrier, the gap tolerances can be selected correspondingly still more narrowly, and the efficiency can be further improved. It is also significant with these achieved improvements that the housing-independent bearing support of the guide blades within a guide blade carrier of the illustrated type of construction permits a constructively simple design of the fluid flow machine. The assembly of the different parts is thus possible practically without tools and in relatively short assembly periods of time. Threaded connections in thermally highly stressed areas are not required which is of great importance for the operating reliability of the fluid flow machine.

It is further advantageous that the turbine housing can be screwed onto the bearing housing in every rotational position without changing thereby the guide blade position. This is of significance in the attachment of the exhaust gas turbocharger to different engines.

While we have shown and described only one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A fluid flow machine, comprising fluid flow housing means, a radial rotor arranged in the housing means, said housing means including a radially extending annular channel means, adjustable guide blade means arranged in the annular channel means, said guide blade means being rotatably supported by bearing pins in bearing bores of housing parts forming the annular channel means, mutually oppositely disposed bearing ring means being embedded in the housing parts forming the annular channel means, said bearing ring means being rigidly coupled at one another by connecting webs into a one-piece structural unit forming a guide blade carrier means, said bearing ring means containing the bearing bores for a bearing support of the guide blade means on both sides, and the surfaces of said bearing ring means forming lateral flow surfaces within the area of the guide blade means.

2. A fluid flow machine according to claim 1, wherein the bearing pins are rigidly connected with guide blade means and the bearing bores of at least one bearing ring means being radially accessible by way of slots of a width corresponding to that of the blade thickness, and at least the bearing pins supported in the slotted bearing bores being considerably larger in diameter than the blade thickness within the area of the bearing pin connections.

3. A fluid flow machine according to claim 2, wherein the bearing pins are connected within the area of the forward edges of the guide blade means.

4. A fluid flow machine according to claim 2, wherein an adjusting ring means includes cams for the guide blade adjustment which project into the flow channel and have aerodynamic blade profile forms.

5. A fluid flow machine according to claim 4, wherein the guide blade carrier means is axially supported on the bearing housing side between a bearing housing means and the flow housing means by way of a formed-on axially extending annular flange means.

6. A fluid flow machine according to claim 5, wherein an axial expansion gap is formed between the outwardly disposed bearing ring means and the housing part in which the outwardly disposed bearing ring means is embedded.

7. A fluid flow machine according to claim 6, further comprising a heat shield, said heat shield and said adjusting ring means being axially fixed by way of end faces and extensions of the annular flange means formed-on at the guide blade carrier means.

8. A fluid flow machine according to claim 7, wherein the bearing pins are connected within the area of the forward edges of the guide blade means.

9. A fluid flow machine according to claim 1, wherein an adjusting ring means includes cams for the guide blade adjustment which project into the flow channel and have aerodynamic blade profile forms.

10. A fluid flow machine according to claim 1, wherein the guide blade carrier means is axially supported on the bearing housing side between a bearing housing means and the flow housing means by way of a formed-on axially extending annular flange means.

11. A fluid flow machine according to claim 1, wherein an axial expansion gap is formed between the outwardly disposed bearing ring means and the housing part in which the outwardly disposed bearing ring means is embedded.

12. A fluid flow machine according to claim 1, further comprising a heat shield and an adjusting ring means, said heat shield and said adjusting ring means being axially fixed by way of end faces and extensions of an annular flange means formed-on at the guide blade carrier means.

* * * * *